US007490457B1

(12) United States Patent
Peck

(10) Patent No.: US 7,490,457 B1
(45) Date of Patent: Feb. 17, 2009

(54) SAFETY REINS

(76) Inventor: Lisa C. Peck, 6011 Francis Ave., Crestwood, KY (US) 40014

( * ) Notice: Subject to any disclaimer, the term of this patent is extended or adjusted under 35 U.S.C. 154(b) by 154 days.

(21) Appl. No.: 11/608,013

(22) Filed: Dec. 7, 2006

Related U.S. Application Data

(60) Provisional application No. 60/747,309, filed on May 16, 2006.

(51) Int. Cl.
*B68B 1/041* (2006.01)

(52) U.S. Cl. ..... 54/36

(58) Field of Classification Search ..... 54/34, 54/36; 119/793, 795, 797, 856; 114/230.26
See application file for complete search history.

(56) References Cited

U.S. PATENT DOCUMENTS

| | | | | |
|---|---|---|---|---|
| 138,872 | A | 5/1873 | Elder et al. | |
| 532,864 | A | 1/1895 | Brittain | |
| 2,561,487 | A * | 7/1951 | Bailhe | 114/230.26 |
| D270,674 | S * | 9/1983 | Erdmann | D30/153 |
| 5,094,062 | A | 3/1992 | Clark | |
| 5,148,656 | A * | 9/1992 | Meaghan | 54/36 |
| 5,247,906 | A * | 9/1993 | Stevenson | 119/795 |
| 5,442,900 | A | 8/1995 | Ciampi | |
| 5,586,514 | A * | 12/1996 | Yuscavage | 114/230.26 |
| 5,966,911 | A | 10/1999 | Gray et al. | |
| 6,098,384 | A | 8/2000 | Porrello | |
| 6,151,872 | A | 11/2000 | Rasmussen | |
| 6,223,508 | B1 | 5/2001 | Schneider | |
| 6,349,527 | B1 | 2/2002 | Keppick | |
| 6,813,872 | B2 | 11/2004 | Gray et al. | |
| 6,827,045 | B1 * | 12/2004 | Willner et al. | 119/795 |
| 2005/0284419 | A1 * | 12/2005 | Bazar | 119/856 |

OTHER PUBLICATIONS

CHRB Focuses on Jockey Safety Issues, posted Jul. 21, 2006.
Sure Lines Inc., web site, Aug. 4, 2006.
Dover Saddlery, web site, Aug. 3, 2006.

* cited by examiner

*Primary Examiner*—Rob Swiatek
(74) *Attorney, Agent, or Firm*—Theresa Fritz Camoriano; Camoriano and Associates

(57) ABSTRACT

A safety rein includes an elongated strap member defining a free end, a central gripping portion, and a loop end, and a cord extending along the central gripping portion and around the loop end, and secured to the elongated strap member.

4 Claims, 8 Drawing Sheets

SAFETY REINS

This application claims priority from U.S. Provisional Application Ser. No. 60/747,309 filed May 16, 2006, which is hereby incorporated by reference.

BACKGROUND

The present invention relates to reins, and, in particular, to safety reins which resist breaking. If a person is riding a horse and the reins break, it may create a very dangerous situation in which the rider may lose control of the horse or may fall off the horse, causing serious injury. Obviously, it would be desirable to prevent that from happening. At the same time, it is preferable that the reins be easy to use and that they not have any parts that may injure the horse or the rider.

SUMMARY

The present invention provides reins that include a safety cord that preserves the integrity of the reins even if the strapping material breaks.

DETAILED DESCRIPTION

Figure 1:
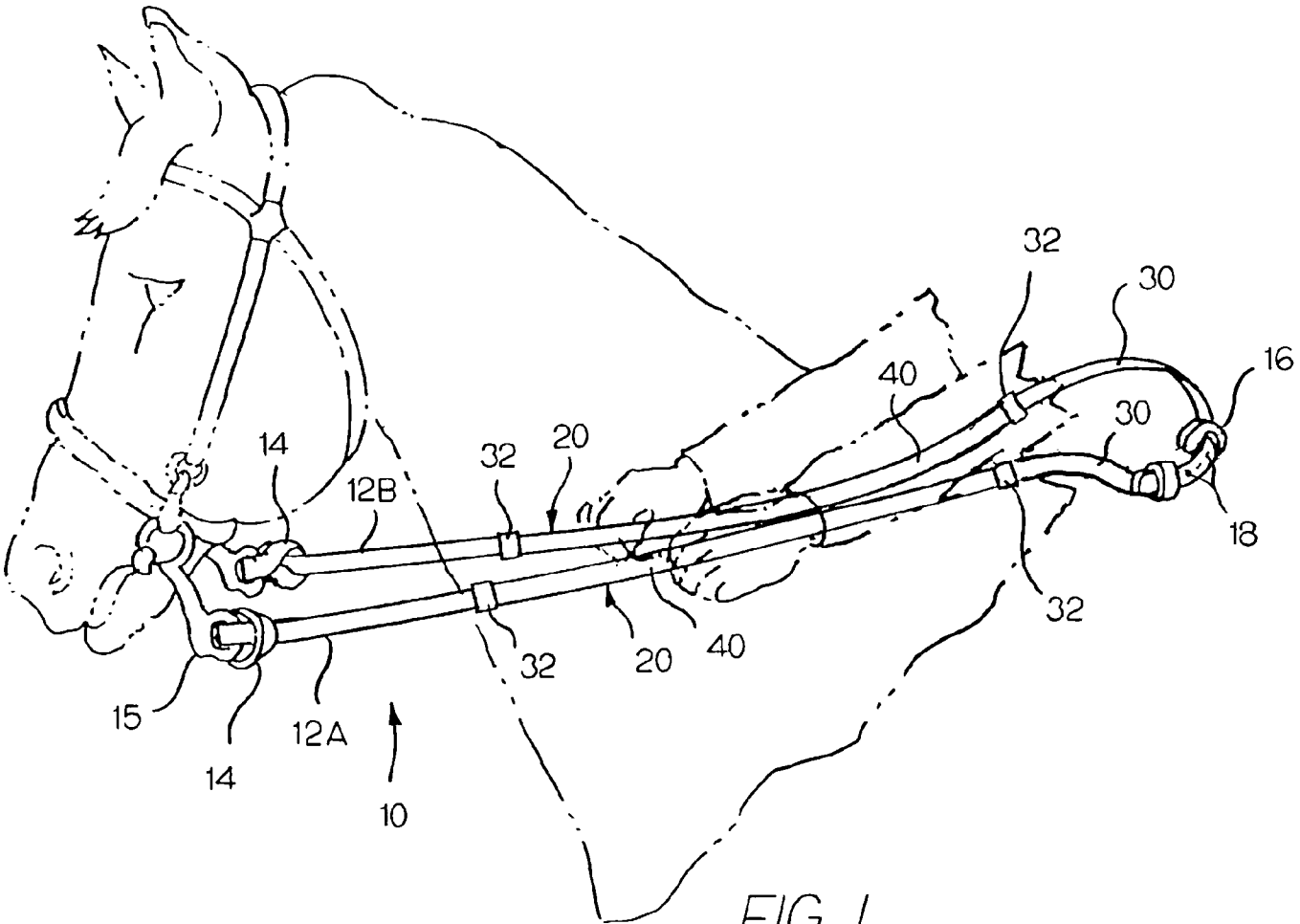
FIG. 1 is a view of a set of reins made in accordance with the present invention as used on a horse, with the horse and rider being shown in phantom.
Figure 13:
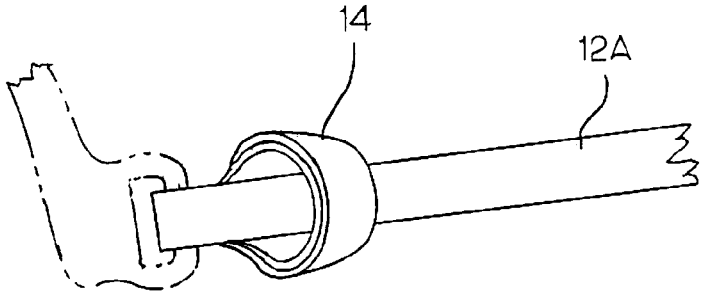
FIG. 13 is an enlarged view of the loop end of the rein of FIG. 3 as it is secured onto a bit, which is shown in phantom.

FIG. 1 shows a pair 10 of reins 12A, 12B made in accordance with the present invention. These are loop end reins. As shown in this view, each of the reins 12A, 12B is an elongated strap member that has a loop 14 at one end which is secured to the bit 15. At the other end, which is referred to here as the free end, one of the reins 12A has a buckle 16, and the other rein 12B has one or more holes 18, which enable the free ends to be buckled together, if desired. The reins 12A, 12B are secured to the bit 15 by passing the free end of the rein through the respective opening in the bit 15 and through the loop end of the respective rein. (See also FIG. 13.) This provides a very secure attachment of the reins 12A, 12B to the bit while not requiring any metal pieces that may come loose or that may injure the horse or the rider.

The reins 12A, 12B in this embodiment are made of leather from the free end to the loop end. (It should be noted that, in alternative embodiments, other strapping materials, such as nylon or synthetic leather, could be used instead.) Each rein 12A, 12B has a central portion 20 in which a knobby rubber tube has been slid over the leather strapping in order to provide the rider a better gripping surface. As can be seen in FIG. 1, the rider grips the reins 12A, 12B along this central portion 20 with the knobby gripping surface.

Figure 2:
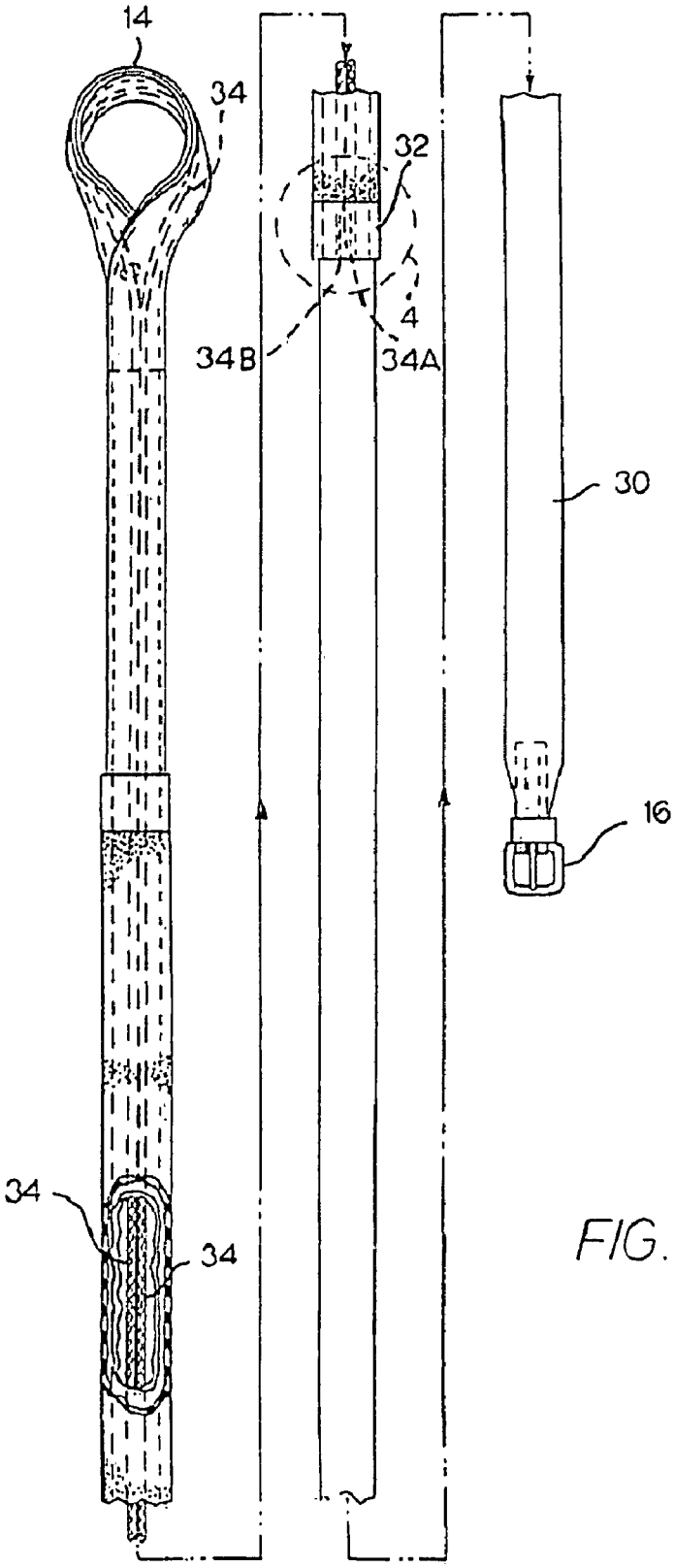
FIG. 2 is a schematic of one of the reins of FIG. 1 with portions broken away to show the interior details.
Figure 3:
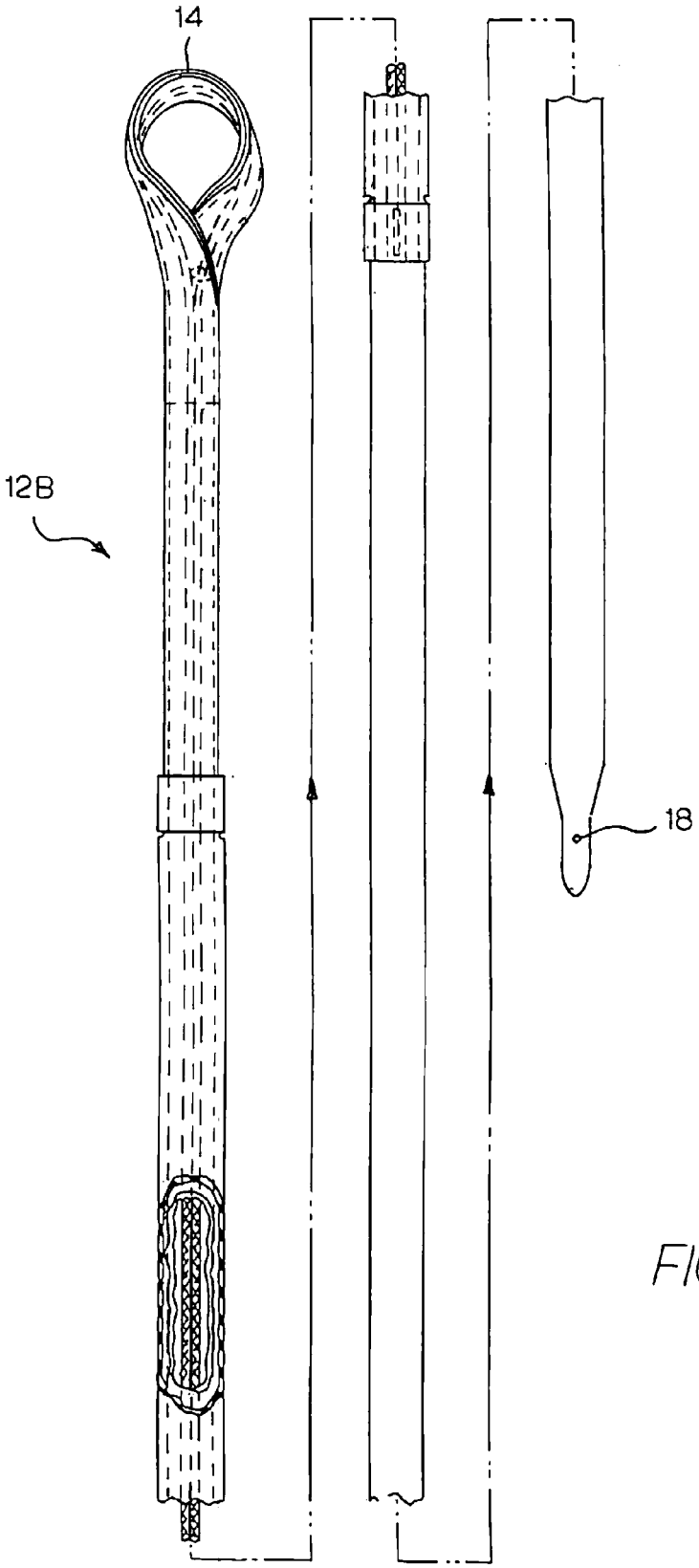
FIG. 3 is a schematic of the other of the reins of FIG. 1.

FIGS. 2 and 3 show the reins 12A, 12B in more detail. These reins are essentially identical to each other, except that the first rein 12A has a buckle 16 at its free end, and the second rein 12B has a hole 18 at its free end to be received by the buckle 16.

Figure 4:
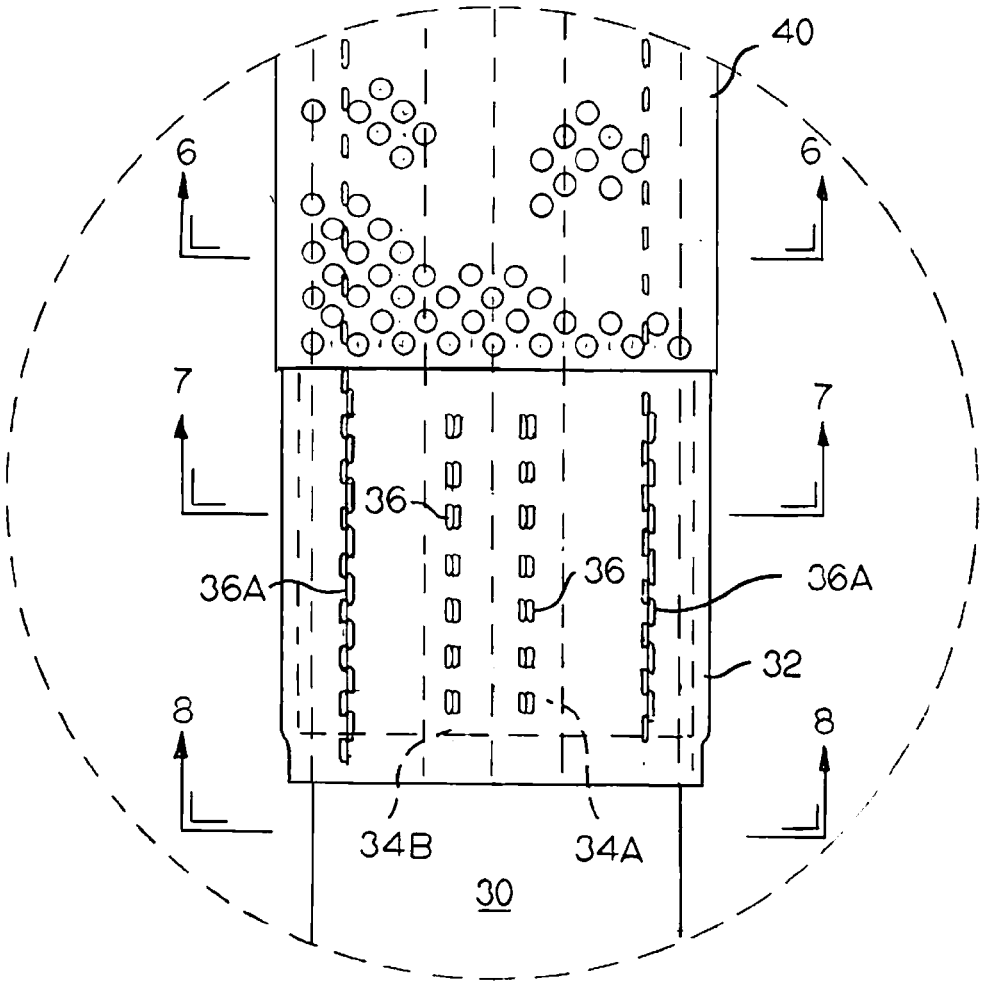
FIG. 4 is an enlarged view of the detail shown in FIG. 2.
Figure 5:
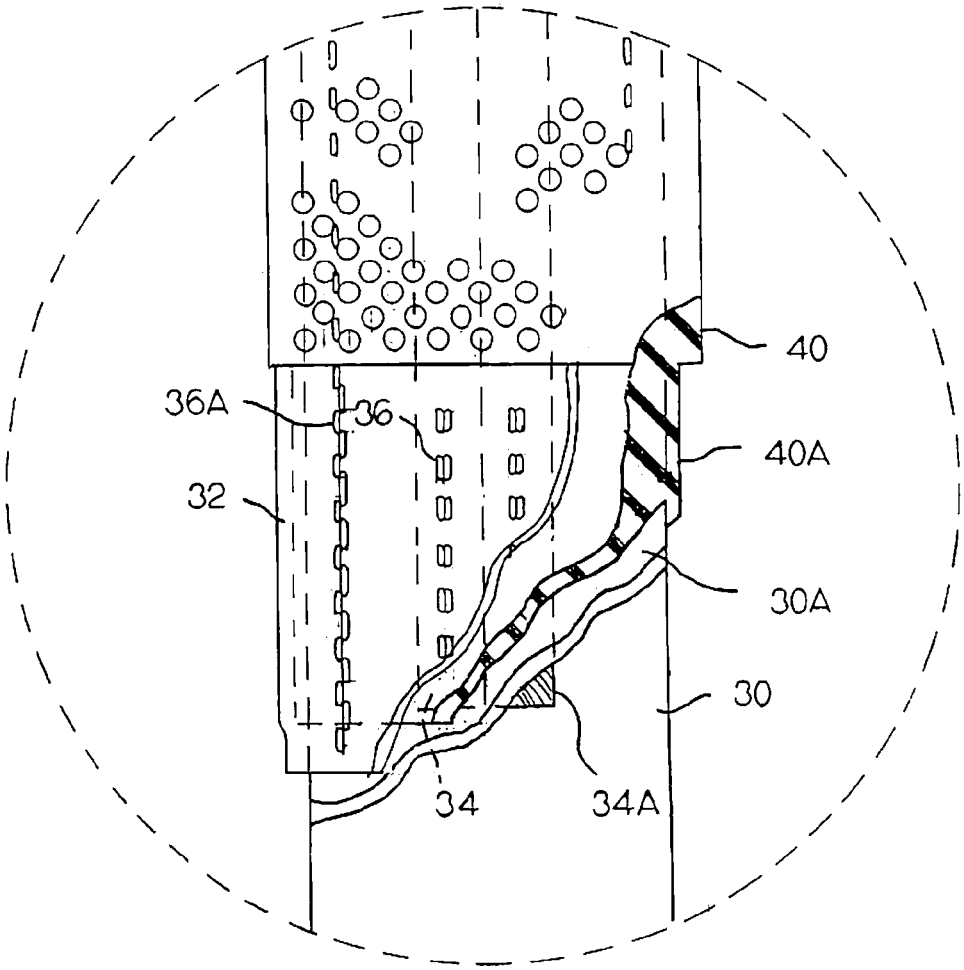
FIG. 5 is the same view as FIG. 4 but with portions broken away.
Figure 7:
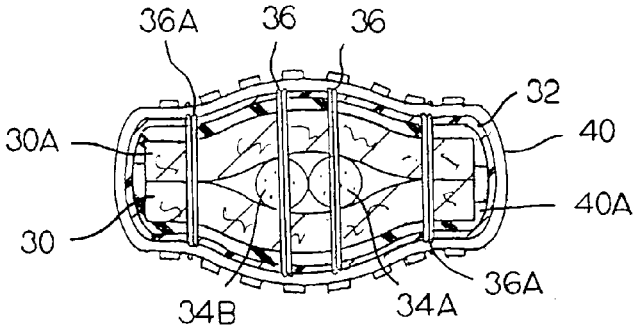
FIG. 7 is a view taken along the section 7-7 of FIG. 4.
Figure 8:
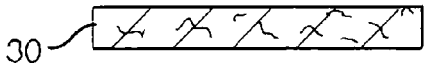
FIG. 8 is a view taken along the section 8-8 of FIG. 4.

Looking now in detail at the rein 12A of FIG. 2, it can be seen that there are several layers of materials used in the rein. At the free end, adjacent the buckle 16, there is just a single layer of leather strapping 30. The detail 4 of FIG. 2 is shown enlarged in FIG. 4, which includes the single layer of leather strapping 30, and a leather band 32 stitched over the main layer 30. There also is a second layer of leather strapping 30A between the band 32 and the main layer 30, which can be seen in the section view of FIG. 7. Also, there are two ends 34A, 34B of a cord 34 between the two leather strapping layers 30A, 30. The ends 34A, 34B are stitched to the leather band 32 and the main layer 30 with stitching 36 extending in the elongated direction of the rein 12A. Additional stitching 36A, also extending in the elongated direction, extends through the band 32 and through both leather strapping layers 30A, 30.

Figure 6:
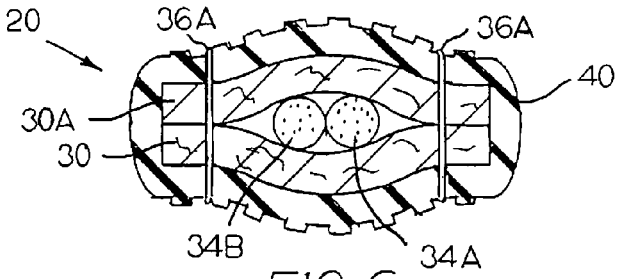
FIG. 6 is a view taken along the section 6-6 of FIG. 4.

Moving toward the loop end of the rein 12A, one reaches the central portion 20 of the rein 12A, which includes the knobby rubber tube 40. The knobby rubber tube 40 has a necked-down portion 40A at each end, and those necked-down portions 40A fit under their respective bands 32. (See FIGS. 4 and 7.) FIG. 6 shows a section through the central portion 20, with the knobby rubber sleeve 40 surrounding the upper and lower leather strapping layers 30A, 30, and the cord 34A,B between the leather strapping layers. While the knobby rubber tube 40 helps with gripping in the central gripping portion of the rein, it is not required.

Figure 10:
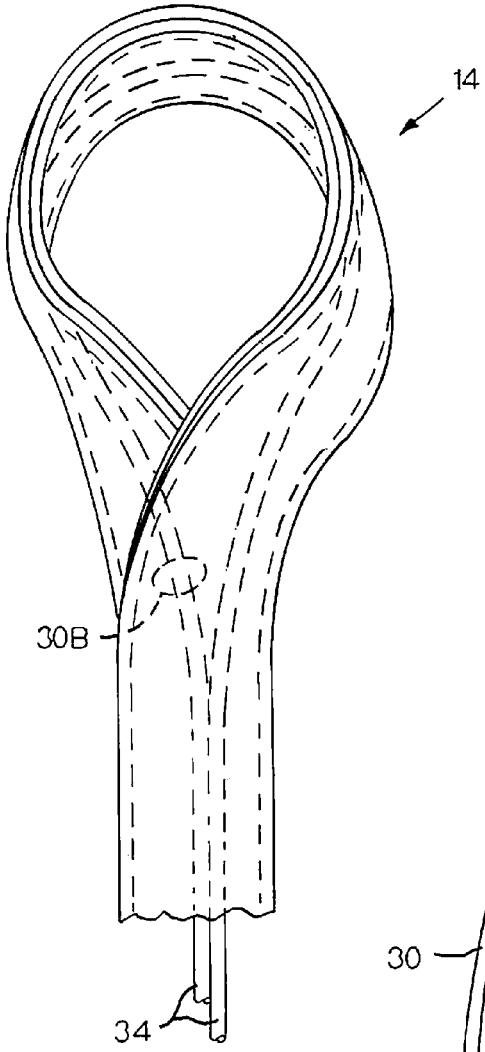
FIG. 10 is a schematic perspective view of the loop end of the rein of FIG. 3.
Figure 11:
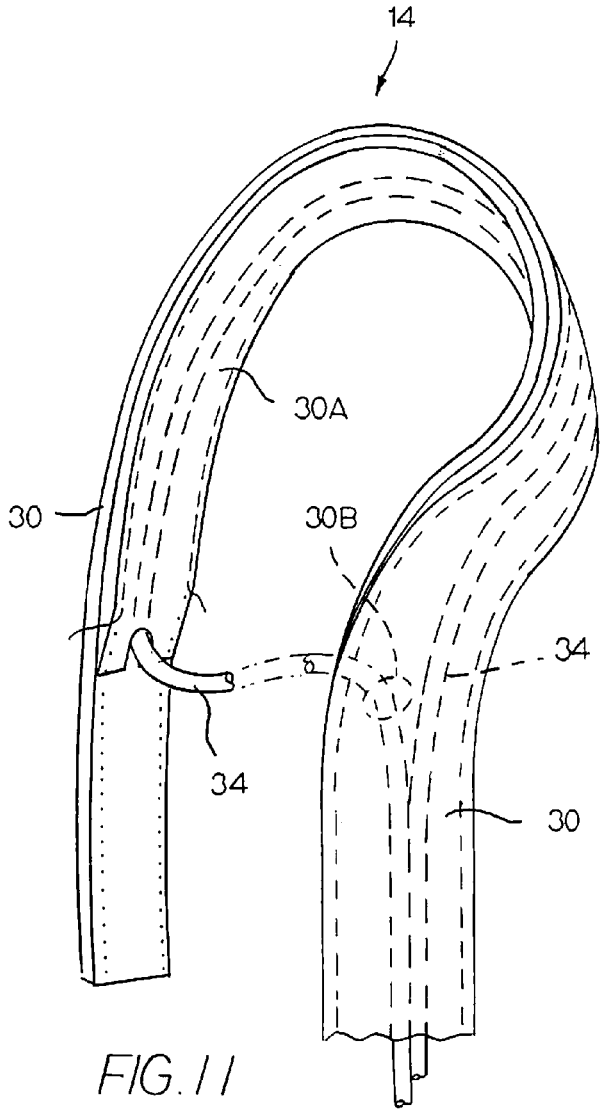
FIG. 11 is the same as FIG. 10 but with the loop end partially unstitched and separated to show more of the detail.
Figure 12:
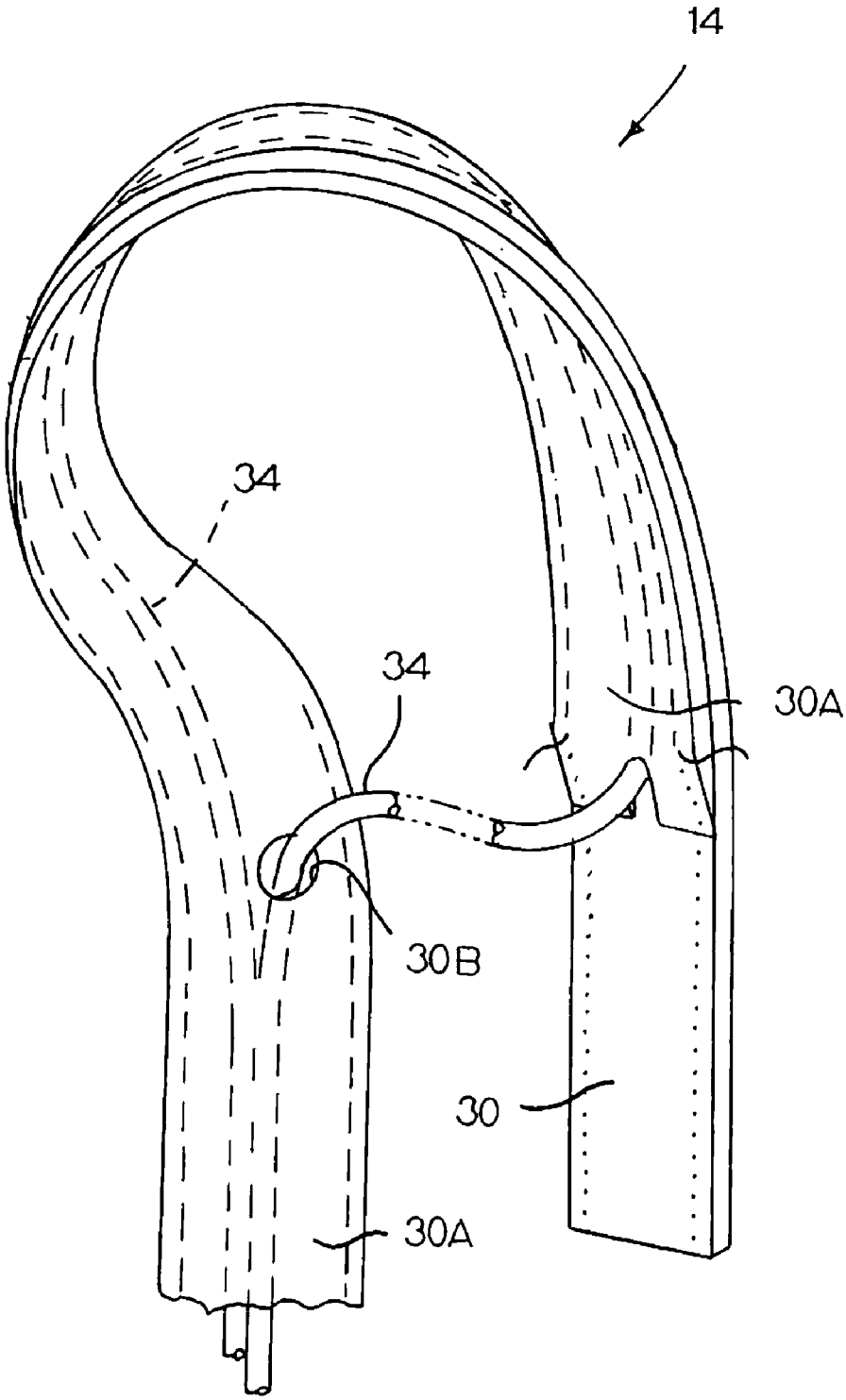
FIG. 12 is a view of the back side of the unstitched end of FIG. 11.

FIGS. 10-12 show the loop end 14. At the loop end 14, the cord 34 passes around the end and then doubles back on itself, passing through a hole 30B in the leather strapping layer 30A so it can make the return trip back to its second end 34B.

As shown in FIG. 2, the cord 34 extends from its first end 34A, toward the loop end 14, passes around the loop end 14, and then comes back to be anchored at its second end 34B. Thus, at the loop end 14 there is just a single layer of cord 34 encased in the leather strapping, but the leather strapping doubles back on itself at the loop end. For most of the distance from the loop end to the point where the ends 34A, 34B are anchored, there is a double layer of cords encased in the leather strapping, since the cord 34 has doubled back on itself. In this embodiment, the cord is a woven nylon parachute cord, which has a high tensile strength and is very durable. However, other suitable materials, having the desired tensile strength and durability may be used. It can be appreciated that the reinforcing cord 34 is substantially enclosed by the single layer of leather strapping 30 and the second layer of leather strapping 30A.

Figure 9:
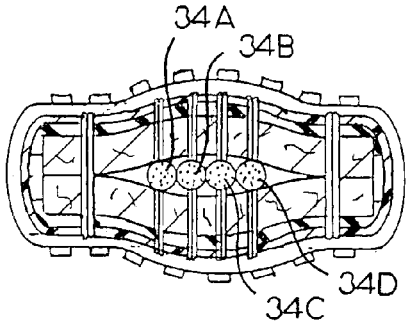
FIG. 9 is the same view as FIG. 7 but showing an alternative embodiment.

FIG. 9 shows an alternative embodiment in which there are two cords, with four ends 34A-D that are anchored in the same manner as in the previous embodiment. Of course, there could be any number of cords, as desired, and the cord may be made of any suitable material that is durable and has sufficient tensile strength to allow the rider to pull on the rein to control the horse, even when the leather strapping has broken.

Thus, these reins provide reinforcement from the bands 32 adjacent the free end, through the central gripping portion 20, all the way to the loop end 14, which is secured to the bit 15 by means of looping through itself. So, if the leather strapping material or the rubber tube were to break, the reinforcing cord would provide a secure back-up, preventing the reins from breaking completely, and the rider would continue to have control of the horse. At the same time, the design shown here has no metal hooks, wires, or other metal parts that could come loose or injure the horse or rider.

It will be obvious to those skilled in the art that modifications may be made to the embodiments described above without departing from the scope of the present invention.

What is claimed is:

1. A safety rein, comprising:

an elongated strap member having a loop end; a free end; and a central gripping portion; and a reinforcing cord anchored near said free end and extending through said central gripping portion and through said loop end, wherein said elongated strap member has first and second layers, and wherein said reinforcing cord includes at least one strand having first and second ends, both of which are anchored to said elongated strap member near said free end, with said cord extending from said free end, between said first and second layers of said elongated strap member to said loop end, between said first and second layers of said elongated strap member around said loop end, and back between said first and second layers of said elongated strap member to said free end.

2. A safety rein as recited in claim 1, wherein said elongated strap member is made of leather and said cord is made of woven nylon.

3. A safety rein as recited in claim 1, wherein said elongated strap member defines an elongated direction and the first and second ends of said reinforcing cord are stitched in the elongated direction to the elongated strap member.

4. A safety rein, comprising:

an elongated strap member having a loop end; a free end; and a central gripping portion; and defining an elongated direction; and a reinforcing cord anchored near said free end and extending through said central gripping portion and through said loop end, wherein said reinforcing cord is substantially enclosed by said elongated strap member and is stitched in the elongated direction to said elongated strap member;

wherein said elongated strap member has first and second layers, and said reinforcing cord includes at least one strand having first and second ends, both of which are stitched in the elongated direction to said elongated strap member near said free end, with said cord routed from said free end, between said first and second layers of said elongated strap member to said loop end, between said first and second layers of said elongated strap member around said loop end, and back between said first and second layers of said elongated strap member to said free end; and further comprising a bit, wherein said elongated strap member is secured to said bit by passing through said bit and through said loop end.

* * * * *